US006392506B2

(12) United States Patent
Wulff

(10) Patent No.: US 6,392,506 B2
(45) Date of Patent: May 21, 2002

(54) RECEIVE/TRANSMIT MULTIPLE CAVITY FILTER HAVING SINGLE INPUT/OUTPUT CAVITY

(75) Inventor: Torsten R. Wulff, Medford, OR (US)

(73) Assignee: Kathrein, Inc., Medford, OR (US)

( * ) Notice: Subject to any disclaimer, the term of this patent is extended or adjusted under 35 U.S.C. 154(b) by 0 days.

(21) Appl. No.: 09/730,073

(22) Filed: Dec. 5, 2000

Related U.S. Application Data

(60) Provisional application No. 60/169,191, filed on Dec. 6, 1999.

(51) Int. Cl.[7] ..... H01P 1/213

(52) U.S. Cl. ..... 333/134; 333/202; 333/206; 333/230

(58) Field of Search ..... 333/134, 227, 333/206, 230, 202

(56) References Cited

U.S. PATENT DOCUMENTS

| | | | | | |
|---|---|---|---|---|---|
| 4,216,448 | A | * | 8/1980 | Kasuga et al. | 333/203 |
| 4,249,147 | A | | 2/1981 | Kaegebein | 333/202 |
| 4,677,402 | A | * | 6/1987 | Cesani et al. | 333/203 |
| 4,890,078 | A | * | 12/1989 | Radcliffe | 333/134 |
| 4,902,991 | A | | 2/1990 | Ishikawa et al. | 333/126 |
| 4,970,480 | A | | 11/1990 | Wong et al. | 333/135 |
| 5,428,325 | A | * | 6/1995 | Jachowski et al. | 333/203 |
| 5,894,250 | A | * | 4/1999 | Ravaska et al. | 333/134 |
| 5,905,416 | A | * | 5/1999 | Schmid et al. | 333/134 |
| 5,963,854 | A | * | 10/1999 | Andreasson et al. | 455/82 |
| 6,025,764 | A | * | 2/2000 | Pelz et al. | 333/202 |

* cited by examiner

*Primary Examiner*—Robert Pascal
*Assistant Examiner*—Dean Takaoka
(74) *Attorney, Agent, or Firm*—Flehr Hohbach Test Albritton & Herbert LLP

(57) ABSTRACT

A receive/transmit multi-cavity filter having input and output filter sections coupled to an antenna by a single cavity.

4 Claims, 2 Drawing Sheets

RECEIVE/TRANSMIT MULTIPLE CAVITY FILTER HAVING SINGLE INPUT/OUTPUT CAVITY

RELATED APPLICATIONS

This application claims priority to Provisional Application Ser. No. 60/169,191 filed Dec. 6, 1999.

BRIEF DESCRIPTION OF THE INVENTION

This invention relates generally to multiple-cavity filter sections having a single input/output resonant cavity, and more particularly to a receive/transmit multiple cavity filter having two sections coupled to an antenna by a single input/output cavity.

BACKGROUND OF THE INVENTION

An RF resonant cavity (or multiple interconnected cavities) can be used to create a RF filter. The filter may either pass a RF signal over a limited frequency range (a bandpass filter) or exclude an RF signal over a limited frequency range (a notch or bandstop filter), depending upon how the resonator is connected to the overall system. A perfect single cavity device would operate at a single, specific frequency (the resonant frequency), however due to material and other considerations all resonant frequency devices operate over a frequency range which encompasses the resonant frequency.

An RF resonant cavity is realized by having a conductive post within an enclosed conductive cavity. The post is connected to the housing at one end and extends towards the top of the housing. The resonant frequency of the cavity is selected by adjusting the length of the post or adjusting the space between the top of the cavity and the post.

In RF communication systems, it is usually desirable to use the same antenna to both transmit (Tx) and receive (Rx) signals. The Tx and Rx signals occupy different frequency ranges, and the antenna is designed to support both frequency ranges with equal signal strength. It is necessary to filter the signals to and from the antenna so that only the Tx signal is passed to the antenna while only the Rx from the antenna is passed to the receiver.

A typical RF communication system employing a common antenna is shown in FIG. 1. The system consists of two filters 11 and 12, one tuned to pass only the Tx frequency range and one tuned to pass only the Rx frequency range. The two filters are combined at the antenna side by a diplexer 13. The diplexer may be either a separate device or integrated into the design of the filters. FIG. 2 is a partial view of a multi-cavity multiple filter for use in an RF communication system in accordance with the prior art. The multi-cavity filter includes first and second sets of multiple resonant cavities 14 and 16, with the cavities in each set coupled to one another through openings 17 and 18, formed respectively therebetween. For clarity, a portion of the walls has been cut away at 19. One set of resonant cavities 14 forms the transmit filter 11, and the other set of resonant cavities 16 forms the receive filter. The transmit and receive filters are fabricated within the same housing. The Tx and Rx signals are combined into a common connector 21. In this case the center conductor 21 of the connector is split and terminated in loops 22 and 23 with loop 23 extending into output cavity 14*a* of the filter section 14 which serves as the transmit filter, and the loop 23 extending into the input cavity 16*a* of the filter section 16 which serves as the receive filter.

The loops are physically attached to the housing or inner conductor of the associated filter cavity. The cross-sectional area between the loops and the return path to the outer housing of the connector is adjusted to tune the output of the filter. Further adjustment of the center conductor loop is required to balance the impedance of the two output cavities, one for the Tx path and one for the Rx path.

The process of tuning and balancing the two loops while maintaining the performance of the filter is quite complicated. Adjusting the loop area for one filter to match the impedance of the second filter alters the tuning of the first filter. This requires re-adjusting of the tuning elements, which in turn influences the impedance of the filter. In addition, it must be performed on each individual filter, it is not a process or characteristic that is common for all filters of a given design.

OBJECTS AND SUMMARY OF THE INVENTION

It is an object of the present invention to provide a simple multi-cavity RF filter having transmitting and receiving filter sections with a single input/output cavity.

There is provided a two-section multi-cavity filter in which the output cavity at one filter section and the input cavity of the other filter section are coupled by a single output/input cavity.

BRIEF DESCRIPTION OF THE DRAWINGS

The foregoing and other objects of the invention will be more clearly understood from the following description when read in conjunction with the accompanying drawings in which.

DESCRIPTION OF THE INVENTION

Figure 3:
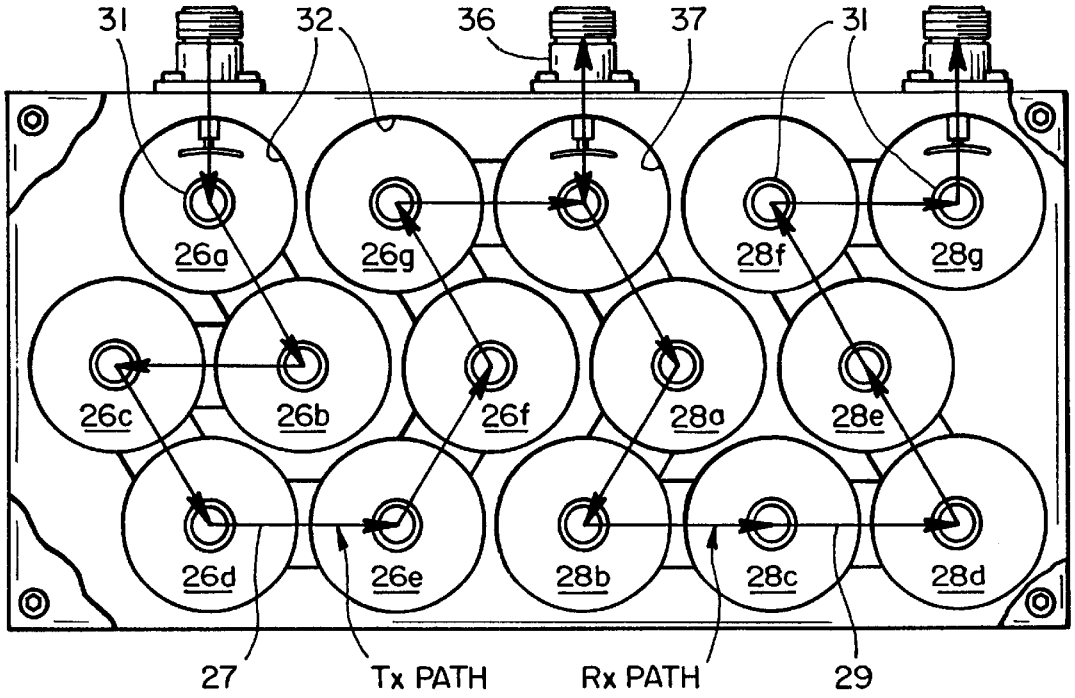
FIG. 3 is a top plan view of a multi-cavity RF transmit and receive filter assembly connected to a single antenna through a single resonant cavity in accordance with the present invention.
Figure 4:
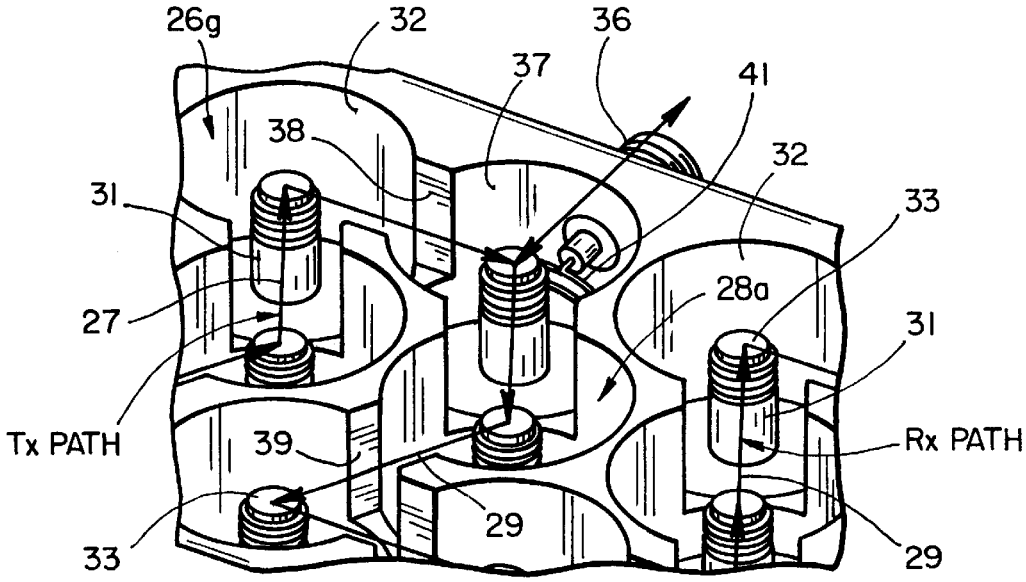
FIG. 4 is an enlarged perspective view of the input/output portion of the filter assembly of FIG. 3 with the top cover removed.

Referring to FIGS. 3 and 4, a multi-cavity two-section transmit and receive filter assembly is illustrated. The transmit section includes resonant cavities 26*a*–26*g*, connected as shown by arrows 27, and the receive section includes resonant cavities 28*a*–28*g*, connected as shown by arrows 29. Each of the cavities includes a center conductor or post 31 with a conductive cavity or housing 32 surrounding the post. The post extends upwardly and is spaced from the top wall of the cavity. The cavity or housing can be formed by machining or by casting aluminum or other metal. An alternative would be to mold the cavity from plastic and provide the interior wall with a conductive coating. The illustrated cavity is tunable by adjusting the height of the post 31. The post includes an adjustable screw (not shown) which engages the post cap 33 to adjust the space between the cap and the top wall of the cavity to thereby tune the cavity. A more complete description of a tunable cavity resonator can be found in co-pending application Ser. No. 60/169,189 filed Dec. 6, 1999 (FHTAH File No. P-68696).

It will be apparent that other types of tunable cavities can be employed to form the transmit and receive sections of a filter assembly for an RF communication system.

The filter sections 26 and 28 are connected to the antenna by a coaxial coupler 36 mounted on the wall of the single input/output cavity 37. The cavities 26*a*–26*g* and 28*a*–28*g* are coupled to one another via openings 38 and 39 formed in the walls between cavities. The coupling between cavities may be adjusted by a tuning mechanism such as described in co-pending application Ser. No. 60/169,188 (FHTAH File No. P-68695) or any other conventional mechanism such as screws which extend into the openings or the like. The cavity resonators 26*a*–26*g* of the transmit section are tuned to pass the transmit RF frequency band from the input coupler while blocking all other frequencies. The cavity resonators 28*a*–28*g* of the receive section are tuned to pass the received frequencies while blocking all other frequencies. Transmit and receive RF signals are coupled to the transmit and receive sections of the multi-cavity filter by the resonant input/output cavity 37. The signals are coupled into the cavity by an electric field loop coupler 41 of the type described in my co-pending application Ser. No. 60/169,186 filed Dec. 6, 1999 (FHTAH File No. P-68697). The configuration and location of the coupling loop 41 is adjustable to thereby tune and determine the impedance of the cavity 37.

Figure 1:
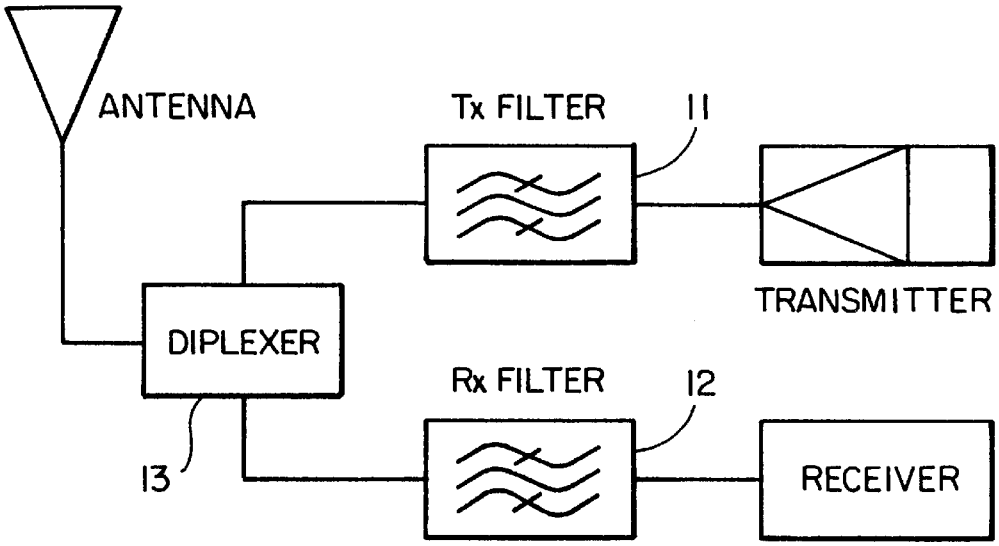
FIG. 1 is a schematic diagram of an RF communication system employing a single antenna.
Figure 2:
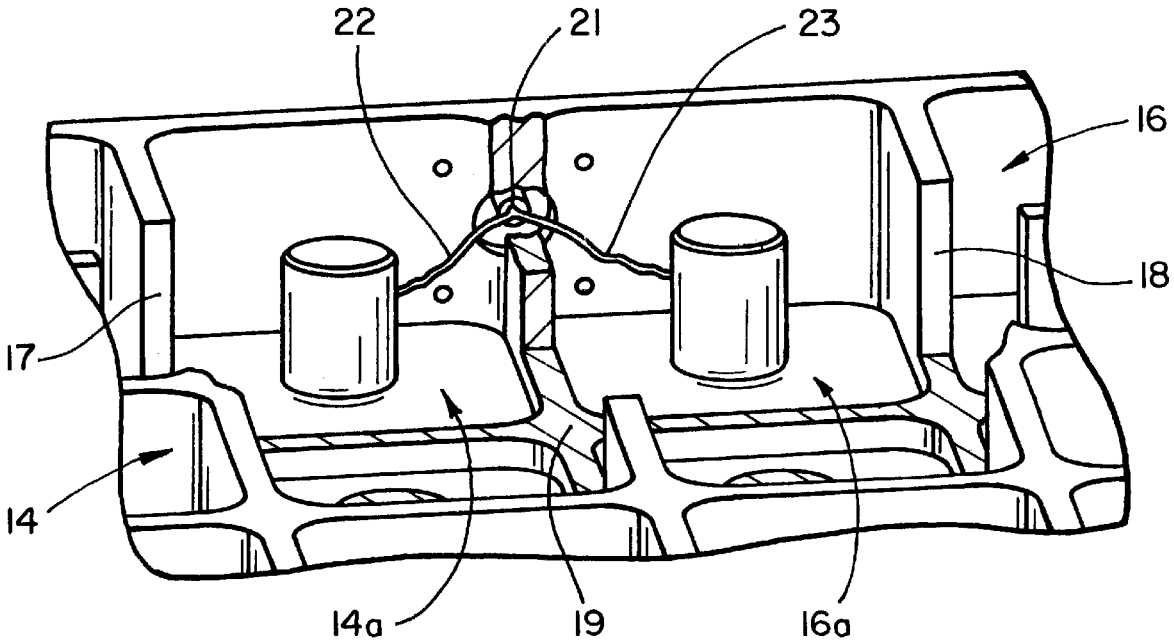
FIG 2 (PRIOR ART)
FIG. 2 is a partial perspective view of a prior art multi-cavity RF transmit and receive filter assembly with connections to a single antenna.

Thus, the filter of the present invention combines the two filter sections using a single cavity as the output/input cavity for both the Tx and Rx filter sections. This provides the dual benefits of elimination of the diplexer as an additional system component and allows the realization of a given multi-cavity filter design with fewer cavities. Referring to FIG. 3, if the performance requirement is such that an 8 cavity Tx and 8 cavity Rx filter is required, the present device would require only 15 cavities to accomplish the same performance goal as the prior art. The present filter assembly into accomplishes the combining of the two filter sections has a single cavity. In the present design the tuning and balancing process is greatly simplified. It is not necessary to balance each filter independently, once the proper coupling between the combining cavity and the adjacent Tx and Rx cavities is determined. The impedance balance between the two filter sections is independent of the tuning, simplifying the tuning process. Finally, the insertion loss (a measure of the losses inherent in the system) is reduced in the present design. The insertion of any device in the signal path causes a reduction in the energy transmitted from the antenna to the transmitter or receiver. The elimination of the diplexer as a separate device eliminates the losses associated with the additional component. Also, there are extra losses even for a system that incorporates the diplexer within the two output cavities, as shown in FIG. 2. This is because each output wire is optimized over the frequency range of it's particular filter section, so the overall device will have a greater insertion loss than the present design, which combines the function into a single device.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A receive/transmit multiple-cavity filter comprising:

a first multiple cavity receiver filter section for connection between an antenna and a receiver, a second multiple cavity transmitter filter section for connection between said antenna and a transmitter, a single tunable input/output cavity connected between the antenna and the first cavity of the receiver filter section and the last cavity of the transmitter section.

2. A receive/transmit multiple-cavity filter as in claim 1 in which the single tunable cavity includes an electric field loop coupler connected to the antenna.

3. A receive/transmit multi-cavity filter as in claims 1 or 2 in which said first and second filter sections include a plurality of coupled tunable cavities.

4. A receive/transmit multi-cavity filter as in claims 1 or 2 in which the cavities of the transmit and receive filter sections are tunable cavities.

* * * * *